United States Patent [19]

Engle

[11] 3,965,619

[45] June 29, 1976

[54] QUICK CHANGE FEED MECHANISM AND ABRASIVE REPLACEMENT

[75] Inventor: Robert C. Engle, Holland, Mich.

[73] Assignee: Ex-Cell-O Corporation, Troy, Mich.

[22] Filed: July 31, 1975

[21] Appl. No.: 600,698

[52] U.S. Cl. ..... 51/58; 51/165.87; 51/263

[51] Int. Cl.[2] ..... B24B 49/00

[58] Field of Search ..... 51/58, 67, 161, 166 TS, 51/2 C, 165.87, 165.88, 165 R, 263

[56] References Cited

UNITED STATES PATENTS

| | | | |
|---|---|---|---|
| 3,490,179 | 1/1970 | Militzer et al. | 51/67 |
| 3,562,960 | 2/1971 | Thielenhaus | 51/58 |
| 3,844,067 | 10/1974 | Gverra et al. | 51/58 |
| 3,909,982 | 10/1975 | Schlotfeld | 51/58 |

*Primary Examiner*—Al Lawrence Smith
*Assistant Examiner*—Robert C. Watson
*Attorney, Agent, or Firm*—James H. Bower; Frank D. Risko

[57] ABSTRACT

An apparatus for quickly changing the abrasive in the tool holder of a grinding, honing or abrasive finishing machine. After the abrasive in a finishing machine is worn out, this device allows the tool holder to be easily and quickly removed and the abrasive stone in the tool holder changed and reset so a minimum of down time is experienced by the operations.

10 Claims, 8 Drawing Figures

FIG. 4
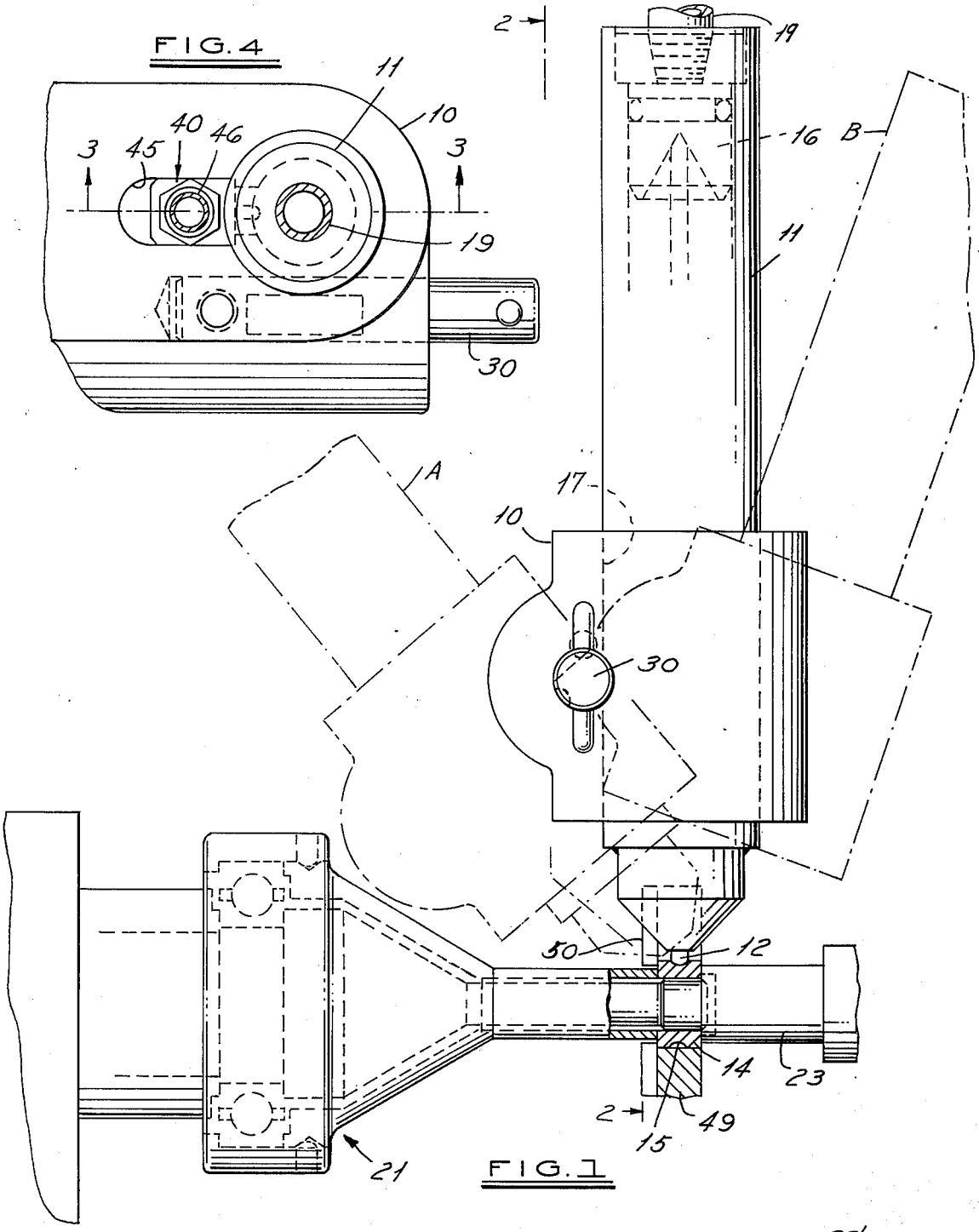
FIG. 1
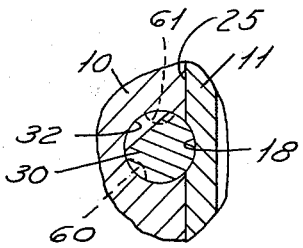
FIG. 5
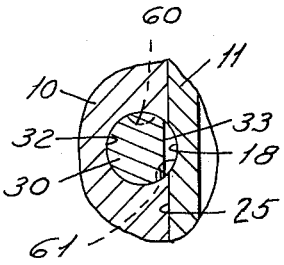
FIG. 6
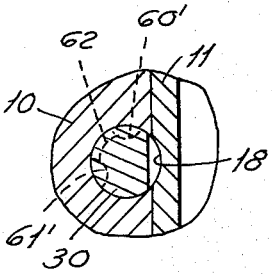
FIG. 7

QUICK CHANGE FEED MECHANISM AND ABRASIVE REPLACEMENT

BACKGROUND

1. Field of Invention

This invention relates to removable tool carriers used to hold abrasives in a honing machine and the locking mechanism for securing the tool carriers.

2. Description of Prior Art

The present method of holding a tool carrier or tool holder on a honing machine is to mechanically fasten this carrier to the tool holder assembly which is a part of the machine which oscillates the abrading tool. This mechanical fastening by screws, bolts or snap rings is designed to hold the carrier so it does not have undesired movement during its oscillation. Because of this method of attachment, the abrasive stone, after it has worn, must be changed with the stone carrier attached to the machine. This change becomes very time consuming because the available room within the honing machine itself is very limited and the task of stone changing becomes very costly. An example of the methods of the tool carriers is shown in U.S. Pat. Nos. 3,067,547 and 3,490,179. In both of these it is impractical to remove the carriers from the respective machine because of other features associated with each design.

SUMMARY

In a honing machine it is a necessary requirement to change abrading stones frequently, especially where high production by automatic loading and unloading of the parts to be honed is being done. This makes the task of changing the abrading stones a time consuming and costly operation if that task takes an inordinate amount of time. An object of this invention is to reduce that time element and make the operation more efficient by having a quick change stone holder which is held in place by a simple locking pin and spring/ball detent. This allows the stone carrier and the stone wear switch to be removed quickly from the machine without unscrewing or removing any fluid actuating lines attached to these elements. Another object of this invention is to allow the tool carrier pin which locks the carrier, to be rotated with a stop action detent which will lock the tool holder and prevent any movement during its use since it, by necessity, must be vibrated. Another object is to have the locking pin secured by a ball/spring detent so it is only necessary to rotate the pin in order to remove the tool carrier. In conjunction with the detent the pin can easily be removed if necessary. Another object is to accurately locate and position the abrading tool in the correct position for proper operation during honing.

Other features and advantages of the replaceable tool holder will become apparent from the description, claims and drawings.

IN THE DRAWINGS:

FIG. 1 is a side view of the part to be honed, mounted and held on the spindle with the honing stone in place;

FIG. 4 is a plan view of the structure shown in FIG. 2;

FIG. 5 is a section view of the locking pin in locked position in FIG. 2 taken along line 5—5 thereof;

FIG. 6 is a section view of the locking pin in unlocked position taken along line 5—5 in FIG. 2;

FIG. 7 is a section view of an alternate construction for locking pin and detent mechanism.

DESCRIPTION

Figure 2:
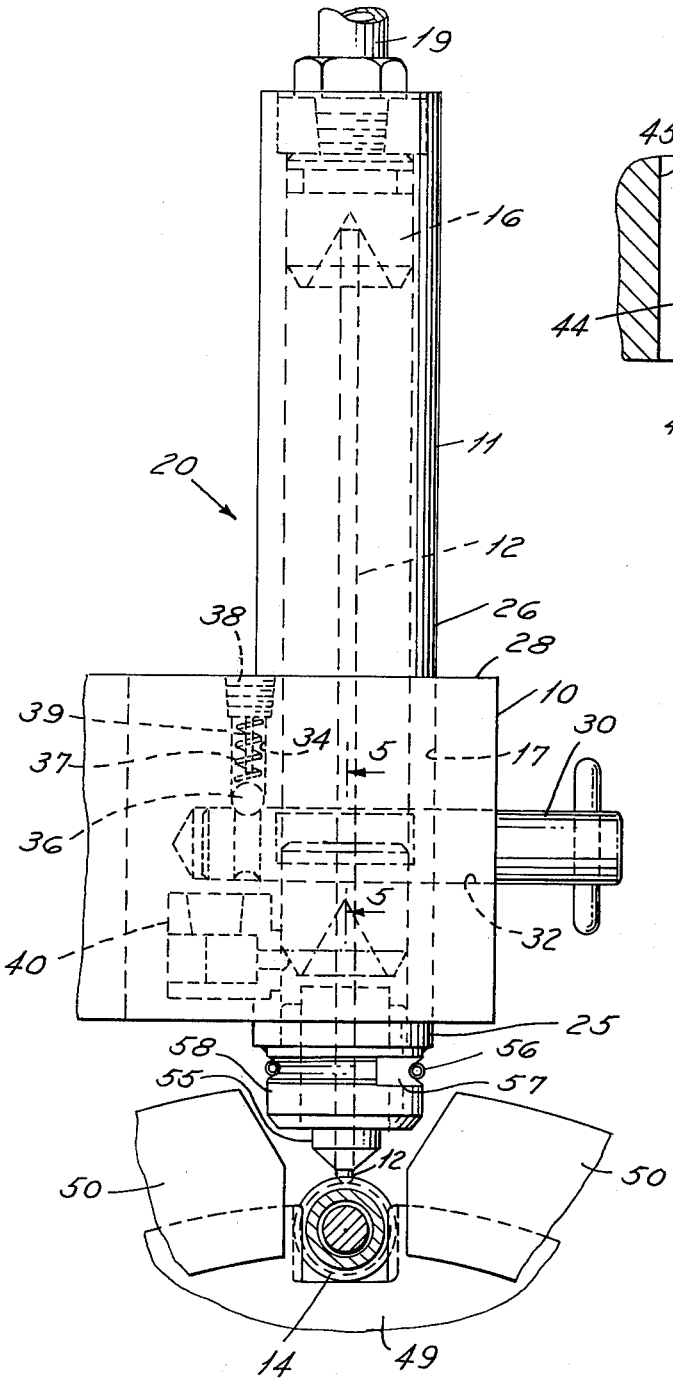
FIG. 2 is a front view of the structure illustrated in FIG. 1 taken along line 2—2 thereof.

Referring to the structure in detail in FIG. 1 the oscillating bridge 10 is conveniently affixed to a mechanism on the honing machine which will oscillate the bridge structure through a given arcuate movement as shown by the phantom positions A and B of the bridge structure. A bore 17 passes through bridge 10 into which the feed cylinder 11 is affixedly held. The feed cylinder 11 houses a vertical disposed stick-type abrasive 12 which is guided, held and fed to the workpiece as seen in FIG. 2. The abrasive stick 12 is adapted to feed downward into the groove 15 of workpiece, or bearing race 14, by piston member 16 when fluid under pressure is admitted to the top of piston member 16 through conduit 19 at the time when bearing 14 is locked in position by pressure/arbor assembly 21 against spindle 23 when spindle 23 is up to speed. The abrasive stick such as shown in this embodiment can have many different sizes and shapes depending on the part to be honed and its characteristic. To accommodate different sticks, an adapter 58 is affixedly held to feed cylinder 11 by some retaining means such as brazing. Within the adapter 58 is mounted guide 55 held in place by key 57 and circular spring 56. Piston 16 is adapted to receive O-ring seal 24 shown in FIG. 3 which prevents fluid from leaking past piston 16 when introduced through conduit 19.

Cylinder 11 is adapted so that diameter 25 may be smaller than diameter 26 and the shoulder developed between these diameters will rest on surface 28 of bridge 10 when feed cylinder diameter 25 is inserted into bore 17. Diameters 25 and 26 may be the same without affecting the vertical location or function of the feed cylinder assembly 20 as will be seen later. Transversing diameter 25 is a lateral locking groove 18 accurately disposed in cylinder 11 to accepted pin 30, best shown in FIGS. 5 and 6. Lateral bore 32 is accurately disposed in bridge 10 and intersects bore 17 wherein pin 30 is closely fitted so it intersects groove 18 in feed cylinder 11 when assembled as seen in FIG. 7. Having been once located by pin 30, the feed cylinder 11 is positively locked into position both vertically and in angularity.

Bore 32 in bridge 10 intersects bore 34 shown in FIG. 2 wherein is located ball 36 biased by spring 37 held in place by plug 38. Affixed into plug 38 is pin 39 which is sized act as a stop for ball 36.

Figure 3:
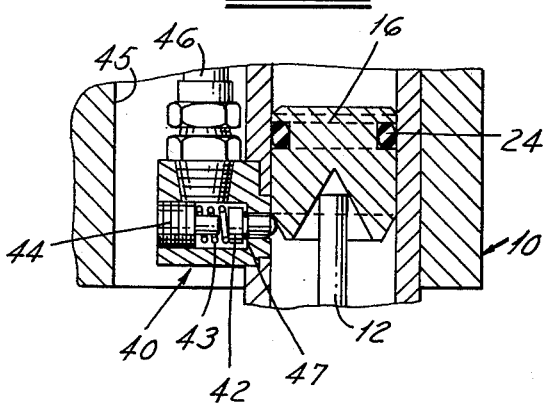
FIG. 3 is a section view of the structure illustrated in FIG. 4 taken along line 3—3 thereof.

FIGS. 3 and 4 show a stone wear switch 40 affixed to cylinder 11 wherein a plunger 42 is disposed and biased against O-ring seal 47 by spring 43 held by plug 44. This switch is fitted into slot 45 within bridge 10 and conduit 46 is connected to any appropriate fluid source. The bearing race 14 is located in the honing machine by index plate 49 and guided by channel guides 50 which allow automatic loading and unloading in the machine.

Figure 8:
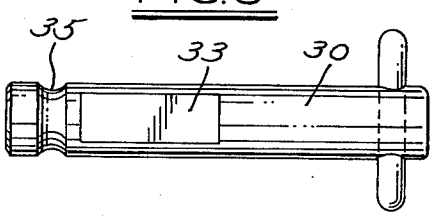
FIG. 8 is a view of locking pin removed from the structure.

Pin 30 shown in FIG. 8 can be configured many different ways. It can have a flat 33 disposed on it and a circular groove 35. It can have an indention such as drill points 60 and 61 shown in FIGS. 5 and 6 disposed thereon or any other convenient shape which will effectively act as a detent for ball 36. FIG. 7 shows the preferred embodiment of detents 60' and 61' located approximately 135° apart and connected by radial groove 62 which is not as deep as detents 60' and 61'.

MODE OF OPERATION

Workpieces such as bearing race 14 is automatically indexed into position by index plate 49 and channel guides 50. The pressure/arbor assembly 21 indexes toward spindle 23 and clamps bearing race 14 in place to be honed. Now in FIGS. 1 and 2 after bearing 14 has reached operating speed, which is a matter of seconds, the conduit 19 to feed cylinder assembly 20 and conduit 46 to the stone wear switch 40 are connected to a fluid source, such as dry factory air, and the stone 12 will be urged toward groove 15 to be honed in bearing race 14. The pressure will cause feed cylinder 11 to be urged outward taking up any tolerance between bore 32, pin 30 and groove 18 in feed cylinder 11. The bridge assembly is then oscillated back and forth as shown by positions A and B in FIG. 1. This oscillating further locks cylinder 11 in place by the centrifugal force developed during this oscillation.

When the honing operation is complete, the bridge 10 and hence the stone are automatically lifted from workpiece, pressure/arbor assembly 21 retracted, workpiece stripped from arbor, index plate moved and a new bearing race workpiece moved into position for honing. As the abrasive 12 wears down, piston member 16 of feed cylinder 11 keeps a constant pressure on the abrasive stick until it is worn beyond its useful length. At this point piston 16 will make contact with plunger 42 of stone wear switch 40 as shown in FIG. 3. When the plunger is actuated, the machine will complete the present operation and the honing machine will then stop. It is now, with my invention, only necessary to rotate pin 30 from the position shown in FIG. 5 approximately 135° clockwise as viewed in FIG. 5, to the position shown in FIG. 6 wherein the flat 33 on pin 30 is approximately parallel to feed cylinder 11 axis. This will now allow the feed cylinder 11 and the stone wear switch 40 as an assembly 20 to be removed from the bridge 10. Abrasive stick 12 is replaced by pulling the remaining portion of stick 12 left in the cylinder assembly 20 out through the stone guide 55. A new stick is inserted into guide 55 and pushed up against piston member 16 which is now moved back to a reset position near the top of assembly 20. This operation will cause switch 40 to be reset by plunger 42 resealing O-ring 47 against its seat and now the feed cylinder and switch assembly 20 can be reinserted in bridge 10 until the shoulder engages surface 28 and then pin 30 can now be rotated counter clockwise approximately 135° until flat 33 is in lock position and hone is now ready for continuing the honing operation. As noted earlier the diameters 26 and 25 of cylinder 11 can be the same diameter. In this embodiment the cylinder assembly 20 would be inserted into bridge 10 and groove 18 of cylinder 11 would be matched to bore 32 of bridge 10 and pin 30 would now be inserted. The closeness of the fit between the cylinder 11 and bore 17 in bridge 10 and with the pin 30 would prevent the assembly 20 from any additional vertical movement and stone wear switch 40 fitted into slot 45 would provide angular location. When the honing operation is in process the vibrating motion of the bridge 10 and hence the cylinder assembly 20 will cause centrifugal forces on the assembly 20 which will further lock it in place. This in concert with the fluid pressure between piston member 16 and top of cylinder 11 will further cause a locking action of the assembly 20 in bridge 10.

Ball 36 held in place by spring 37 and plug 38 act as a detent in conjunction with groove 35 in pin 30 to prevent pin 30 from being pulled out of bridge 10. In this embodiment a flat is not necessary but the pin 30 must be removed by overcoming detent and the cylinder assembly 20 can be removed. This type mechanism would further require a seat at the intersection of bores 34 and 32 to prevent the ball 36 from falling into bore 34 when the pin 30 is removed.

In another embodiment the groove 35 in pin 30 can be replaced by small flats, drill points, or some conveniently shaped indentions 60 and 61 shown in FIGS. 5 and 6 so that the locked open and locked closed positions can be easily ascertained by feel of the ball 36 denting in the indentation regardless of the direction of rotation of the pin 30.

The preferred embodiment shown in FIG. 7 has the groove 35 in pin 30 replaced by detents 60' and 61' which are connected by radial groove 63. Here pin 39 is retained in plug 38 and sized in length so that when ball 36 is detented in groove 63 there will be sufficient clearance between ball 36 and pin 39 but not enough to allow pin 30 to be removed from bridge 10. This will prevent accidental loss or removal of pin 30. Also the detents 60' and 61' are deeper than groove 63 so that the extreme positions of locked open and locked closed can be ascertained by feel of ball 36 detenting. This embodiment also will only allow the pin 30 to be rotated between the two detent positions with detent 60' and 61' in conjunction with pin 39 acting as stops to prevent further movement since the ball 36 cannot overcome the detent step without hitting pin 39.

This invention in summary solves a number of problems which have existed in the industry. The ability to easily remove the abrasive stick feed cylinder from its mounting in a fast and efficient manner using a ball/-spring detent and pin makes changing the stick simple and economical. Having the stone wear switch a part of this feed cylinder assembly allows both fluid lines connecting to the assembly to be removed simultaneously without disconnecting them from the main fluid lines which again reduces the need for removal of fluid connections. The captured ball associated with the spring, plug detent mechanism securely locks the feed cylinder assembly and minimizes assembly disassembly time.

Minor modification may be made to the device shown by persons skilled in the art and all such modifications are considered within the spirit and scope of the invention except as limited by the appended claims.

I claim:

1. In a honing machine having an abrasive mounted on an oscillating bridge wherein the apparatus for affixing said abrasive to said bridge comprises:

a. feed cylinder having an internal feed means wherein said abrasive is housed;

b. said bridge having a bore wherein said feed cylinder projects therethrough;

c. a lateral groove in said cylinder aligned with a lateral bore in said bridge; and d. a pin disposed in said lateral bore means and said groove means locking said cylinder in said bridge.

2. The apparatus of claim 1 wherein said pin means is retained in said bridge by a ball/spring detent means and a radial groove in said pin means.

3. The apparatus of claim 2 wherein a flat is disposed on said pin such that said flat can be aligned to allow removal of said feed cylinder with said pin disposed in said lateral bore.

4. The apparatus of claim 3 wherein said radial groove is disposed between two indentations on said pin and said ball/spring detent interacts therewith.

5. The apparatus of claim 4 wherein said indentations located approximately 135° apart and said ball/spring detent has retained plug means having a pin extending therefrom.

6. The apparatus of claim 1 wherein a fluid operated stone wear switch is affixedly held to feed cylinder.

7. The apparatus of claim 6 wherein said pin means is retained in said bridge by a ball/spring detent means and a radial groove in said pin means.

8. The apparatus of claim 7 wherein a flat is disposed on said pin such that said flat can be aligned to allow removal of said feed cylinder with said pin disposed in said lateral bore.

9. The apparatus of claim 8 wherein said radial groove is disposed between two indentations on said pin and said ball/spring detent interacts therewith.

10. The apparatus of claim 9 wherein said indentations located approximately 135° apart and said ball/-spring detent has retained plug means having a pin extending therefrom.

* * * * *